US010618787B2

(12) United States Patent
Kasan

(10) Patent No.: US 10,618,787 B2
(45) Date of Patent: Apr. 14, 2020

(54) PRY BAR

(71) Applicant: Eli Kasan, Pittsburgh, PA (US)

(72) Inventor: Eli Kasan, Pittsburgh, PA (US)

( * ) Notice: Subject to any disclaimer, the term of this patent is extended or adjusted under 35 U.S.C. 154(b) by 0 days.

(21) Appl. No.: 15/425,006

(22) Filed: Feb. 6, 2017

(65) Prior Publication Data

US 2017/0144876 A1 May 25, 2017

Related U.S. Application Data

(63) Continuation-in-part of application No. 14/804,498, filed on Jul. 21, 2015, now abandoned.

(60) Provisional application No. 62/027,530, filed on Jul. 22, 2014.

(51) Int. Cl.

| | |
|---|---|
| ***B66F 15/00*** | (2006.01) |
| ***B25C 11/00*** | (2006.01) |
| ***E04G 23/08*** | (2006.01) |

(52) U.S. Cl.

CPC ..... *B66F 15/00* (2013.01); *B25C 11/00* (2013.01); *E04G 23/08* (2013.01); *E04G 2023/085* (2013.01)

(58) Field of Classification Search

CPC ..... B25C 11/00; B66F 15/00; E04G 23/08
USPC ..... 254/131, 131.5, 25, 17; 294/22; 81/119
See application file for complete search history.

(56) References Cited

U.S. PATENT DOCUMENTS 2,680,003 A * 6/1954 Feinstein ..... E04G 23/08 254/131
3,134,574 A 5/1964 Reuterfors
D211,755 S * 7/1968 Yeager ..... D8/89
4,649,613 A * 3/1987 Bednarik ..... B25B 27/02 29/253
5,095,604 A * 3/1992 Baker ..... B25B 27/02 29/239
5,165,659 A * 11/1992 L'Heureux ..... B66F 15/00 254/131
5,447,289 A 9/1995 Callahan
5,467,830 A * 11/1995 Watson ..... A01B 1/16 172/378
5,695,172 A * 12/1997 Hreha ..... B66F 15/00 254/18
7,338,032 B2 * 3/2008 Sykes, Jr. ..... B66F 15/00 254/21
D618,978 S * 7/2010 Nolle ..... D8/89
7,753,342 B1 * 7/2010 Nolle ..... B66F 15/00 227/63
8,342,482 B2 1/2013 Smith
8,434,739 B1 * 5/2013 Connolly ..... B66F 15/00 254/130
8,763,225 B2 * 7/2014 Bruce ..... B25B 27/02 29/270
D718,109 S * 11/2014 Gantt, Jr. ..... D8/89
9,493,330 B2 * 11/2016 Nestor ..... B66F 15/00
(Continued)

*Primary Examiner* — Orlando E Aviles
*Assistant Examiner* — Seahee Yoon
(74) *Attorney, Agent, or Firm* — David G. Oberdick

(57) ABSTRACT

Pry bars that will not slip off a lower support structure (such as joints) when prying attachment devices (such as nails or screws) from architectural members (such as deck boards) because the two paws or distal ends of the hook members are fully engaged with one or more lower support structures throughout the prying operation. The pry bar has a handle and a head, with the head having a fulcrum and two hook or paw members.

11 Claims, 6 Drawing Sheets

(56) References Cited

U.S. PATENT DOCUMENTS

| | | | | |
|---|---|---|---|---|
| 2008/0083305 | A1* | 4/2008 | Miley | B25B 13/02<br>81/437 |
| 2008/0191181 | A1* | 8/2008 | Verbowski | B25G 1/10<br>254/25 |
| 2010/0140575 | A1* | 6/2010 | Liou | B66F 15/00<br>254/131.5 |
| 2014/0027688 | A1* | 1/2014 | Vesely | B66F 15/00<br>254/131.5 |
| 2014/0182107 | A1* | 7/2014 | Nestor | B66F 15/00<br>29/426.5 |

* cited by examiner

PRY BAR

CROSS-REFERENCE TO RELATED APPLICATIONS

This is a continuation-in-part application which claims the benefit of and priority to U.S. Nonprovisional patent application Ser. No. 14/804,498 filed on Jul. 21, 2015, which claims priority to U.S. Provisional Application Ser. No. 62/027,530, titled PRY BAR, filed Jul. 22, 2014, which is incorporated by reference herein in its entirety.

FIELD OF THE INVENTION

The invention relates generally to a pry bar.

BACKGROUND AND SUMMARY OF THE INVENTION

Commercially available pry bars slip off a lower support structure (such as joints) when prying attachment devices (such as nails or screws) from architectural members (such as deck boards) because the two paws or distal ends of the hook members are not fully engaged with a lower support structure throughout the prying operation. Also, commercially available pry bars are not capable of providing a horizontal twisting action to posts or panels as part of construction or demolition efforts.

The present invention addresses these issues through use of a modified pry bar that includes a pair of L-shaped paw members that can be angled to address the slippage issue.

BRIEF DESCRIPTION OF THE DRAWINGS

Embodiments of the present invention will now be described, by way of example only, with reference to the accompanying drawings for the purpose of illustrating the embodiments, and not for purposes of limiting the invention, wherein.

DETAILED DESCRIPTION OF THE INVENTION

Figure 1:
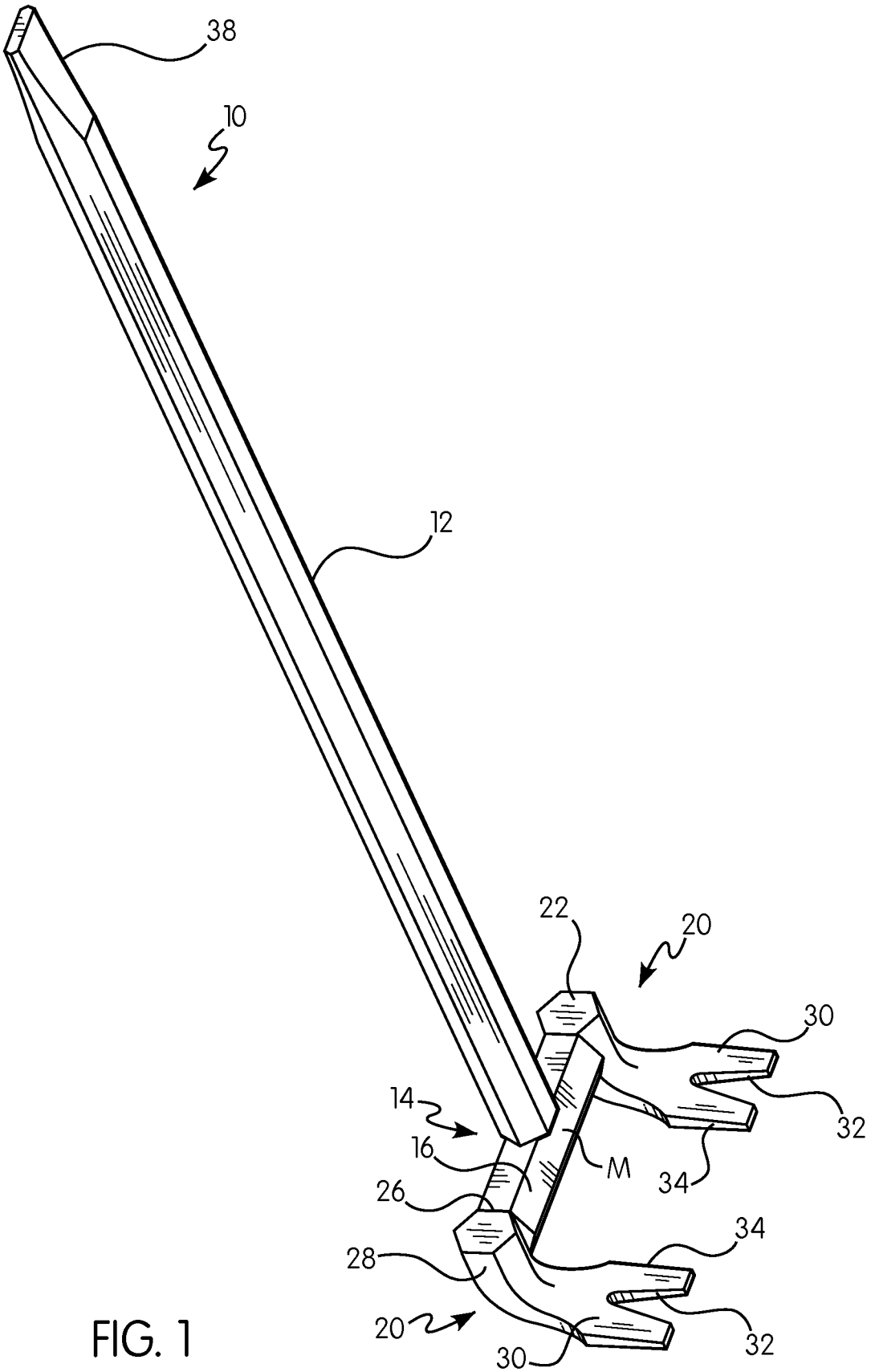
FIG. 1 is an perspective right side front view of one embodiment of the present invention.
Figure 2:
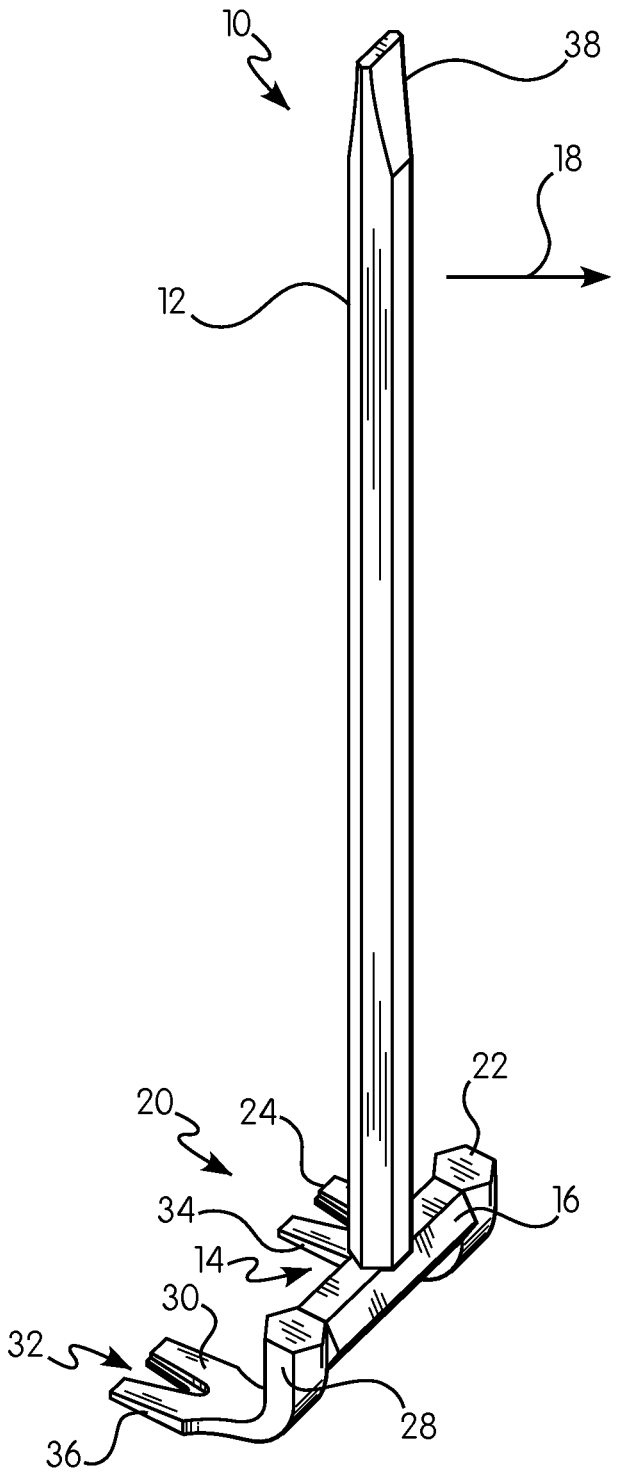
FIG. 2 is an perspective left side rear view of the embodiment of the present invention of FIG. 1.
Figure 3:
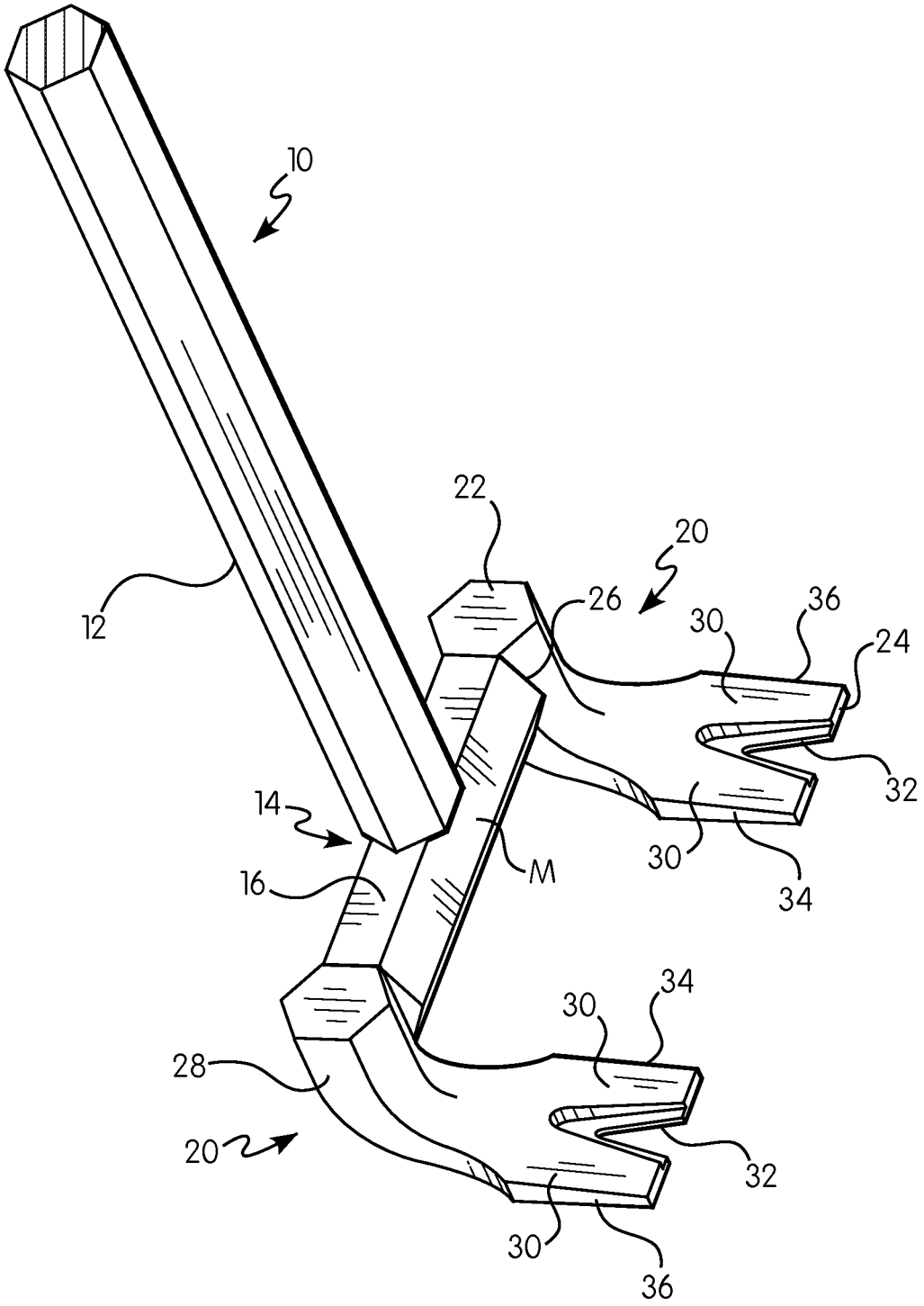
FIG. 3 is a partial perspective right side front view of the embodiment of the present invention of FIG. 1 illustrating the pry head.

Referring now to FIGS. 1-7, in which like numerals indicate like parts, the pry bar of the present invention is shown generally at 10 for facilitating prying a flat member, such as a deck board, from slender members, such as joists (not shown).

The pry bar 10 comprises a handle 12 and a head 14. The head 14 extends perpendicularly from the handle 12 at the midpoint M of the head 14. The head 14 is used for engaging under the flat member and functions as a fulcrum 16 by engaging the slender members and thereby causing the head 14 to pry the flat member from the slender members when the handle 12 is pushed away from the head 14 in a direction of arrow 18 (FIG. 2) by the fulcrum 16 pivoting on the slender member.

The head 14 comprises a fulcrum 16 and a pair of L-shaped paw members 20. The pair of L-shaped members 20 each have proximal ends 22, respectively, and distal ends 24, respectively.

The handle 12 is elongated and generally straight, and, in one embodiment, is comprised of hex steel. In one embodiment of the invention, the handle 12 includes a wedge-shaped prying portion 38 at the top of handle 12, which adds further function to pry bar 10 as a whole.

Figure 4:
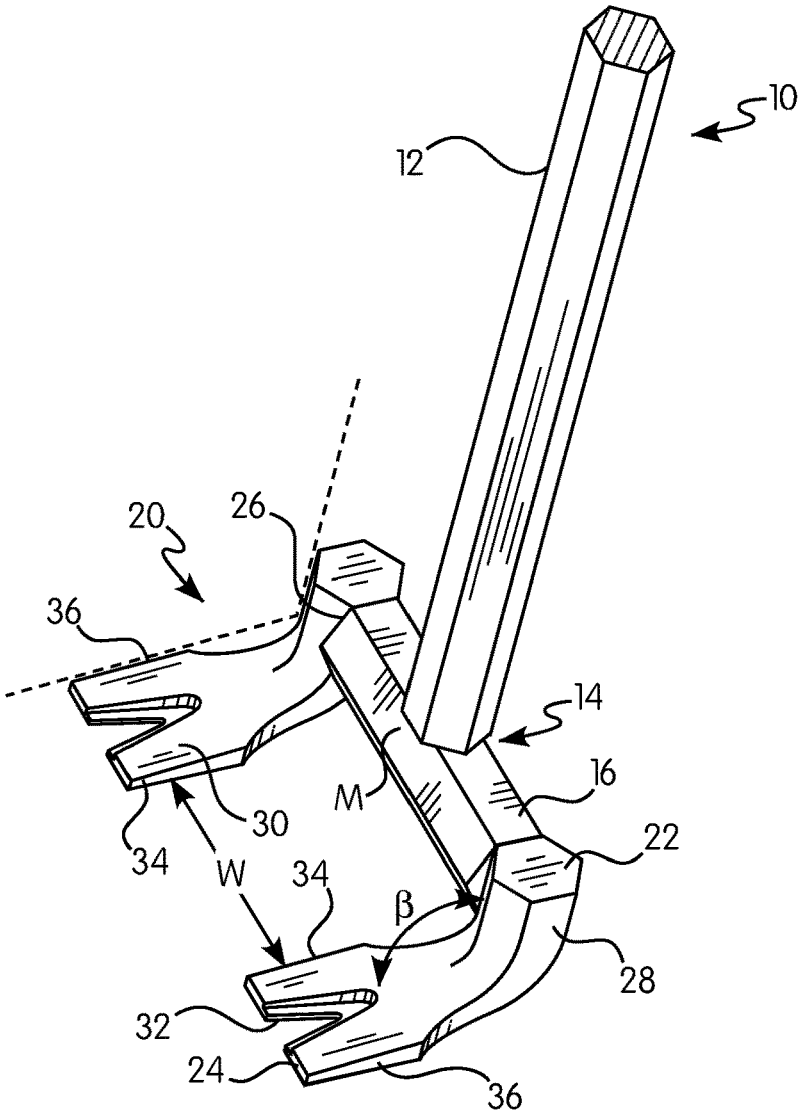
FIG. 4 is a partial perspective left side front view of the embodiment of the present invention of FIG. 1 illustrating the pry head.
Figure 6:
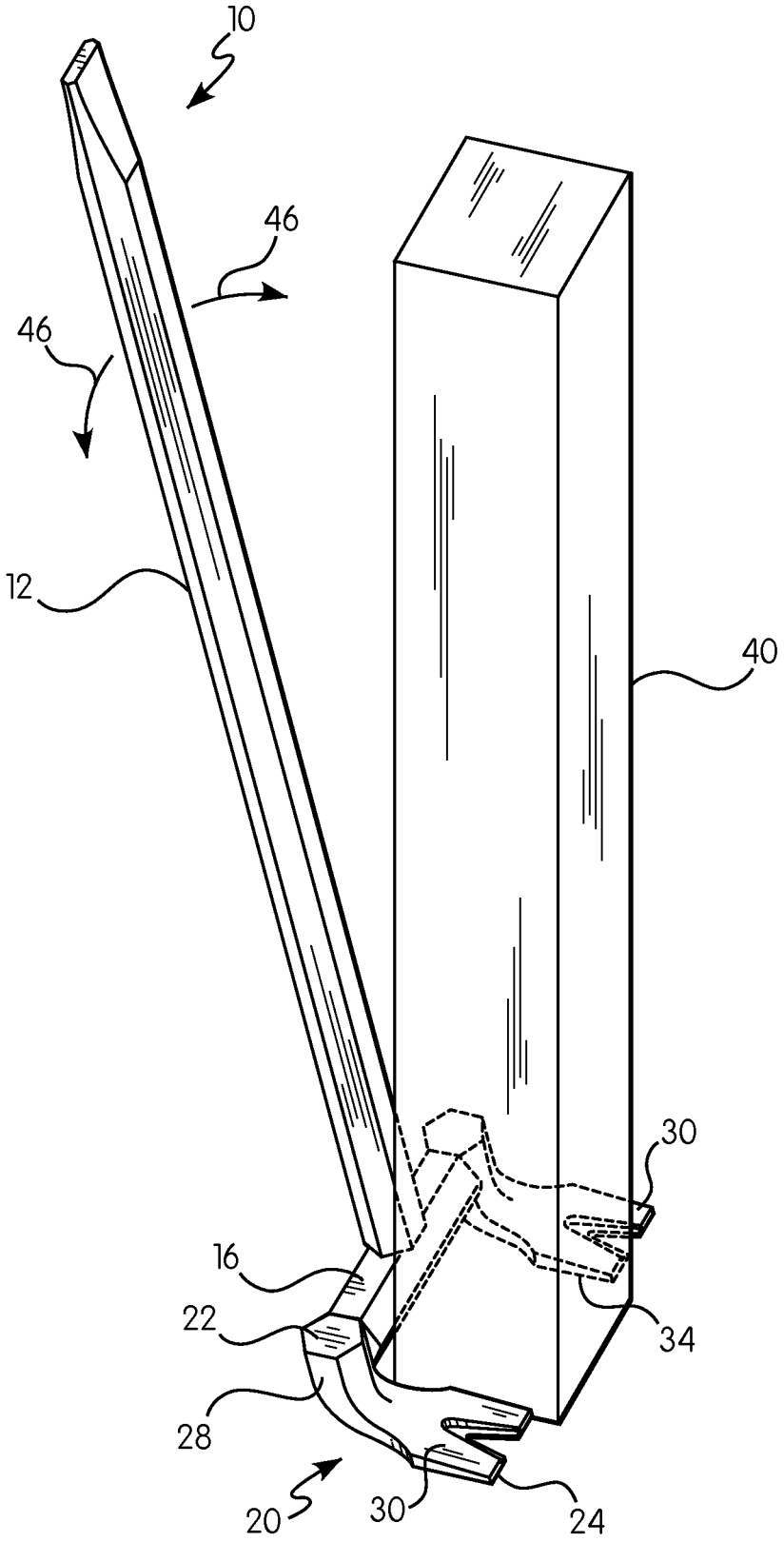
FIG. 6 is a perspective left side front view of the pry head of the present invention of FIG. 1 in use with a post.
Figure 7:
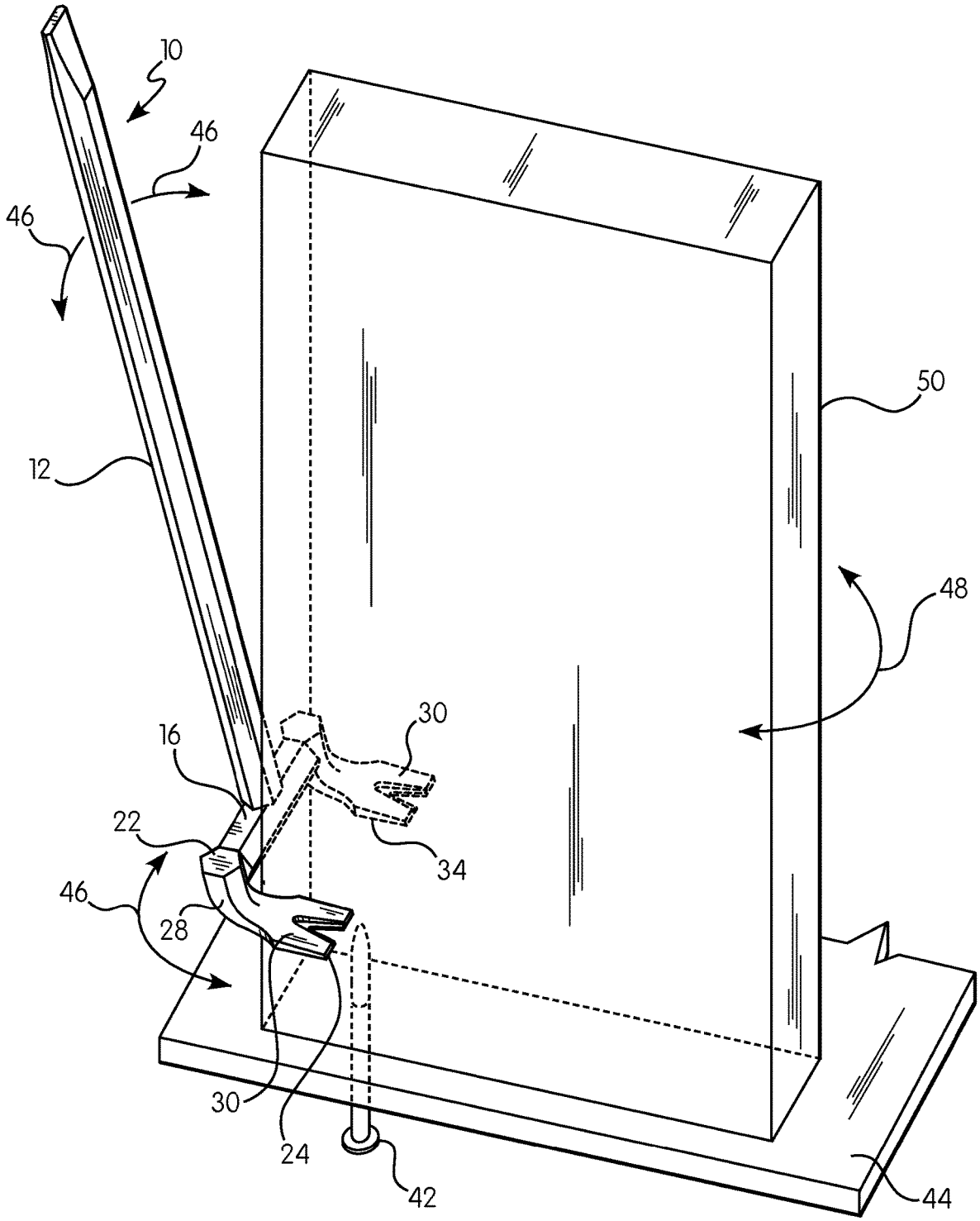
FIG. 7 is a perspective left side front view of the pry head of the present invention of FIG. 1 in use with a panel.

The pair of generally L-shaped paw members 20 of the head 14 are formed by two sections oriented at an angle β (as shown in FIG. 4) that can range between 60 degrees to 120 degrees therewith: attachment portion 28 and prying portion 30. Attachment section 28 is elongated and generally straight, and, together with the prying portion 30, forms a paw member 20 that is generally L-shaped. Prying portion 30 is flat and generally straight including distal end 24. Each prying portion 30 has an inside exterior edge 34 and an outside exterior edge 36. In a preferred embodiment, edges 34 and 36 are parallel to each other (although they can also be non-parallel), and the width (W) between the inside exterior edges 34 can range from 1.0 inches to 3.75 inches (on-center). In the event that pry bar 10 is intended for use, for example, with a 1½ inch wide joist/panel or post, width (W) would have to be greater than 1½ inch in order to allow inside exterior edges to clear around the joist/panel or post. For example, a width (W) of 2 inches would allow the inside exterior edges to clear around a 1½ inch joist/panel or post as shown in FIGS. 6 and 7. The distal ends 24 of the pair of L-shaped paw members 20 of the head 14 are formed into claws 32, respectively, for facilitating nail pulling and the like. Attachment portions 28 extend at proximal ends 22 perpendicular from ends 26 of fulcrum 16 and in parallel orientation with the longitudinal plane of handle 12. Attachment portions 28 can be formed, for example, by hex steel.

The fulcrum 16 is elongated and generally straight and round, for example hex steel. The roundness in lateral cross section facilitates pivoting on the slender member. The fulcrum 16 ties the pair of L-shaped paw members 20 of the head 14 to each other, while keeping the pair of L-shaped paw members 20 of the head 14 properly spaced-apart from each other.

Referring to FIG. 4, edges 36 and 34, in one preferred embodiment, are perpendicular to the plane formed by handle 12 and fulcrum 16. In all embodiments, edges 36, along with distal ends 24, do not extend outward. This assists the pry bar in fitting between posts or other structures, i.e., distal ends 24 do not create outward protrusions that would catch on posts or other structures. In this respect, the distance between outer edges 36 can be a predetermined distance.

Figure 5:
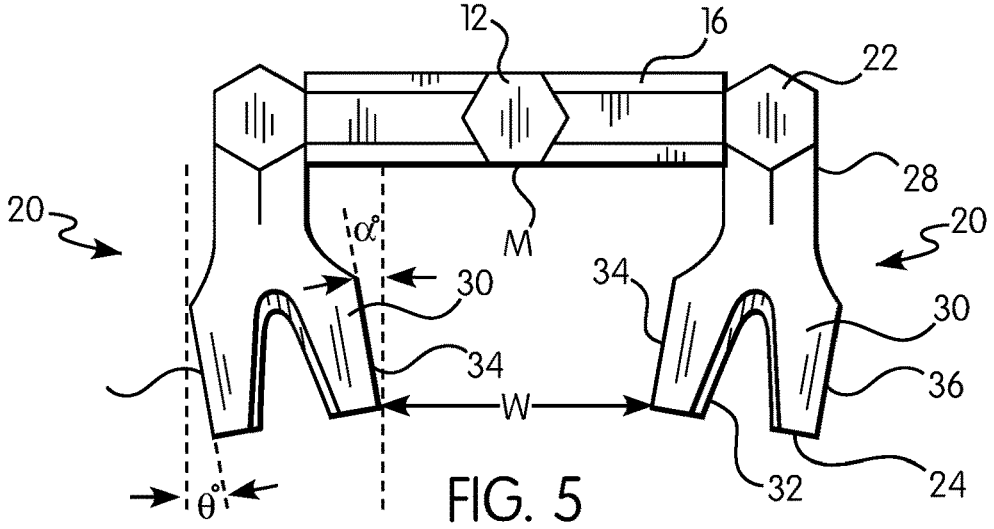
FIG. 5 is a top view of the present invention of FIG. 1.

As shown in FIG. 5, however, outside edges 36, together with the distal ends 24 of the pair of prying portions 30 can be oriented towards (inward) each other, thereby forming a non-perpendicular orientation with the longitudinal plane of handle 12 and fulcrum 16, as denoted by angle θ. In a preferred embodiment, angle θ ranges between 0 degrees and 45 degrees, although other angles are possible. As Angle θ varies, outer edges 36, again, can have a predetermined distance.

Referring generally to FIGS. 4-7, inside edges 34 are perpendicular to the longitudinal plane of handle 12 and fulcrum 16 in one embodiment and can also angle inward to each other as shown in FIG. 5, as shown by angle α. Angle a ranges between 0 degrees and 45 degrees, although other angles are possible. Inside edges 34 do not angle outward, with the orientation of inside edges 34 serving to aid the use of pry bar 10 as a twisting tool as shown in FIG. 6. More specifically, horizontal boards, vertical posts or other building members in various positions can be loosened or moved by placing paw-shaped members 20 around the board, post, joist or other member and then twisting or rocking pry bar 10 sideways. This expands the functional capabilities of the pry bar beyond standard pry bars. In this context, and in one preferred embodiment, angle α ranges between 5 and 10 degrees, with this inward angle a enhancing the ability of inside edges 34 to grip an intermediary member while pry bar 10 is twisted or rocked sideways. If inside edges are angled outward, however, the paw-shaped members 20 lose their ability to grip a board, post or member situated between members 20.

This twisting action capability of pry bar 10 is shown more specifically in FIGS. 6 and 7. In FIG. 7, pry bar 10 is situated so that prying portions 30 and claws 32 lie on opposite sides of post 40 (with width (W) of sufficient distance to permit inside edges 34 to span post 40). In this configuration, a twisting of pry bar 10, as shown by arrows 46, causes inside edges 32 to contact opposite sides of post 40 and thereby twist post 40 about its longitudinal axis. This twisting motion can assist in positioning post 40 during construction or removing post 40 from attached members, rails or frames during demolition. As shown in FIG. 7, pry bar 10 can be used to interact in a similar manner with panel 50, whereby movement of pry bar 10 as shown by arrows 46 causes panel 50 to rotate about nail 42 and, as shown by arrows 48, position panel 50 on board 44. In this context, nail 42 or other similar means can be used as a first attachment of panel 50 to board 44, and the twisting movement of pry bar 10 helps adjust panel 50 before other attachments are made. In addition, although not shown, pry bar 10 can be used to straddle the longitudinal side edge of a joist (similar to what is shown in FIG. 7, albeit in a vertical orientation) that is connected at the opposite edge, and, by twisting and/or rocking the pry bar, cause the joist to become loosened and disconnected as part of demolition. In all of these examples, spacing can exist between the inside edges 34 and post 40 or panel 50 situated between claws 32. In this context, it is, again, important that inside edges do not angle outward from each other, as this would diminish the ability of inside edges to hold against an intermediary post or panel while pry bar is twisted or rocked back and forth.

The materials for the above mentioned features can be any materials suitable to withstand the operational forces, such as steel, aluminum, titanium, cast iron, brass, composites, or combinations thereof. For example, one embodiment of the present invention can be hex steel for the entire invention with machining fabrication to create certain features, such as the flat prying portion 30 with claws 32. The features can be fabricated separately as sub-components and welded together to form a monolithic structure or be extruded to form a starting structure that is monolithic.

It will be understood that each of the elements described above, or two or more together, may also find a useful application in other types of constructions differing from the types described above. While the invention has been illustrated and described as embodied in a pry bar for prying a flat member from a slender member, however, it is not limited to the details shown, since it will be understood that various omissions, modifications, substitutions and changes in the forms and details of the device illustrated and its operation can be made by those skilled in the art without departing in any way from the spirit of the present invention.

What is claimed is:

1. A pry bar capable for use in prying and twisting a construction member, the pry bar comprising:

a handle, and a head that extends perpendicularly from the handle at a midpoint of the head, the head comprising:

a fulcrum having first and second ends, a first L-shaped paw member having a proximal end and a distal end, and being attached at the proximal end of the first paw member to the first end of the fulcrum and having a tapered claw at the distal end of the first paw member, with the claw having with an outside edge that tapers to a distal outer claw end, an inside edge that tapers to a distal inner claw end, and an inner v-groove; and a second L-shaped paw member having a proximal end and a distal end, and being attached at the proximal end of the second paw member to the second end of the fulcrum and having a tapered claw at the distal end of the second paw member, with the claw having with an outside edge that tapers to a distal outer claw end, an inside edge that tapers to a distal inner claw end, and an inner v-groove;

wherein the distal ends of the first and second paw members are oriented inward toward each other in a plane substantially perpendicular to the plane formed by the handle and head, such that the outside edges of the claws in the first and second L-shaped paw member are oriented inward at an angle (θ) formed opposite the distal ends of the first and second paw members and in respect to the plane perpendicular to the plane formed by the handle and head, and the angle (θ) is greater than 5 degrees and up to 45 degrees; and the inside edges of the claws in the first and second L-shaped paw member are oriented inward at an angle (α) formed at the distal ends of the first and second paw members and in respect to the plane perpendicular to the plane formed by the handle and head to present the distal inner claw ends for engagement with the construction member, and the angle (α) is greater than 5 degrees and up to 45 degrees; and whereby the first and second L-shaped paw members are operable to:

pry the construction member in a manner where an axis of rotation of the pry bar as the construction member is being pried is substantially parallel to the plane in which angles (θ) and (α) are formed; and twist the construction member located between the inside edges of the claws in the first and second L-shaped paw member and having a width equal to or less than width between the inside edge of the first paw member and the inside edge of the second paw member, with such twisting occurring in a manner where the inside edge of the claw near the distal end of the first paw member and the inside edge of the claw near the distal end of the second paw member grip the construction member and twist the construction member with an axis of rotation substantially perpendicular to the plane in which angles (θ) and (α) are formed.

2. The pry bar of claim 1, wherein a width between the inside edge of the first paw member and the inside edge of the second paw member is between about 1.0 inches and about 3.75 inches.

3. The pry bar of claim 1, wherein the outside and inside edges of each paw member are parallel.

4. The pry bar of claim 1, wherein the outside and inside edges of each paw member are non-parallel.

5. The pry bar of claim 1, wherein each L-shaped paw member is formed by an attachment portion and a prying portion and the attachment portion and prying portion are oriented at an angle (β) that can range between 60 degrees to 120 degrees.

6. The pry bar of claim 1, where the handle and head are comprised of metal.

7. The pry bar of claim 1, wherein the handle and head are comprised of hex steel.

8. The pry bar of claim 7, wherein the handle and head are fabricated separately as sub-components and welded together to form a monolithic structure.

9. The pry bar of claim 7, wherein the handle and head are extruded to form a monolithic structure.

10. The pry bar of claim 1, wherein the handle includes a wedge-shape prying member at a top of the handle.

11. The pry bar of claims 1 or 3, wherein the angle (θ) and the angle (α) are between 5 and 10 degrees.

* * * * *